US007773909B2

(12) United States Patent
Rumpel et al.

(10) Patent No.: US 7,773,909 B2
(45) Date of Patent: Aug. 10, 2010

(54) METHOD FOR HANDLING AN ENDLESS BELT FOR AN ELECTROPHOTOGRAPHIC PRINTER, AND A STORAGE UNIT HAVING A RETAINING DEVICE FOR THIS ENDLESS BELT

(75) Inventors: Peter Rumpel, Feldkirchen-Westerham (DE); Winfried Topp, München (DE)

(73) Assignee: Oce Printing Systems GmbH, Poing (DE)

( * ) Notice: Subject to any disclaimer, the term of this patent is extended or adjusted under 35 U.S.C. 154(b) by 1022 days.

(21) Appl. No.: 10/550,933

(22) PCT Filed: Apr. 14, 2004

(86) PCT No.: PCT/EP2004/003919

§ 371 (c)(1),
(2), (4) Date: Aug. 23, 2006

(87) PCT Pub. No.: WO2004/090645

PCT Pub. Date: Oct. 21, 2004

(65) Prior Publication Data

US 2007/0009285 A1 Jan. 11, 2007

(30) Foreign Application Priority Data

Apr. 14, 2003 (DE) ..... 103 17 165

(51) Int. Cl.
*G03G 15/00* (2006.01)

(52) U.S. Cl. ..... 399/107; 399/162; 206/393

(58) Field of Classification Search ..... 399/117, 399/162, 164, 165
See application file for complete search history.

(56) References Cited

U.S. PATENT DOCUMENTS

| | | | | |
|---|---|---|---|---|
| 3,186,543 | A * | 6/1965 | Minick et al. | 206/393 |
| 3,332,546 | A | 7/1967 | George | |
| 3,888,577 | A | 6/1975 | Meyer | |
| 4,162,009 | A * | 7/1979 | Schouten | 206/389 |
| 4,811,839 | A | 3/1989 | Cornell et al. | |
| 5,119,133 | A | 6/1992 | Swain | |

(Continued)

FOREIGN PATENT DOCUMENTS

| | | |
|---|---|---|
| DE | 28 35 167 | 3/1979 |
| DE | 196 39 402 | 3/1998 |
| DE | 102 04 640 | 12/2003 |

OTHER PUBLICATIONS

Technologie der Océ-Drucker—Kapitel 3—pp. 75-112.

*Primary Examiner*—David M Gray
*Assistant Examiner*—Roy Yi
(74) *Attorney, Agent, or Firm*—Schiff Hardin LLP

(57) ABSTRACT

In a method and system for handling of an endless belt for an electro-photographic printer or copier, an endless belt is borne with aid of a first, a second, and a third cylindrical body. The first cylindrical body is inserted through a loop of the endless belt. The second cylindrical body is arranged outside of the loop of the endless belt and parallel to the first cylindrical body. The endless belt is wound around the first and the second cylindrical bodies. The third cylindrical body is provided through the loop at a free end of the endless belt. The cylindrical bodies with the wound endless belt are housed in a container.

9 Claims, 6 Drawing Sheets

U.S. PATENT DOCUMENTS 5,163,265 A 11/1992 Darcy et al.
5,708,924 A 1/1998 Shogren et al.
6,366,750 B1 * 4/2002 Swain ..... 399/116
2003/0138267 A1 * 7/2003 Yamazaki et al. ..... 399/162

* cited by examiner

METHOD FOR HANDLING AN ENDLESS BELT FOR AN ELECTROPHOTOGRAPHIC PRINTER, AND A STORAGE UNIT HAVING A RETAINING DEVICE FOR THIS ENDLESS BELT

BACKGROUND

The present preferred embodiment concerns a method for handling of an endless belt for an electrophotographic printer or copier as well as a unit that comprises an endless belt and a holder, and a system for electrophotographic printing or copying.

The endless belt can, for example, be a photoconductor belt as it is used in modern printers and copiers as an intermediate carrier. Such a photoconductor belt has a photoconducting coating that is initially charged to generate a latent charge image and is then exposed, whereby the change on the exposed points dissipates. The latent charge image so generated can then be developed with toner, and the toner image can be transfer-printed from the photoconductor belt in one or more further steps. Such a photoconductor belt is therefore designated as an intermediate carrier.

The photoconducting coating of the endless belt can be an inorganic photoconductor (for example ZnO) or an organic photoconductor. Details regarding such photoconductor belts and their functionality are, for example, specified in chapter 3 of the handbook "Das Druckerbuch" by G. Goldmann, 7th edition, 2002, ISBN 3-000-001019-X", which is incorporated by reference into the present specification. Such photoconductor belts are consumable parts and must be exchanged at regular intervals. This means that the photoconductor belts must also be stored outside of the printer or copier, must be transported and inserted into the printer or copier, and must be removed therefrom. Such further activities are summarized in the present document with the term "handling" of the photoconductor belt.

The handling of photoconductor belts is made more difficult since the photoconductor belt is relatively sensitive, in particular sensitive to buckling, and therefore an inappropriate handling of the photoconductor belt easily leads to a damaging of the same.

Methods for transport and for packaging of an endless belt are known from U.S. Patents U.S. Pat. No. 3,888,577, U.S. Pat. No. 5,708,924 A and U.S. Pat. No. 4,811,839. In all of these methods, the packaged endless belt has at least approximately the shape that it also has in the installed state in a printer or copier. This leads to a large and consequently unwieldy and expensive packaging.

Further prior art is contained in U.S. Patents U.S. Pat. No. 5,119,133 A, U.S. Pat. No. 5,163,265 A, U.S. Pat. No. 3,186,543 A, U.S. Pat. No. 3,332,546 A and U.S. Pat. No. 4,811,839 A.

SUMMARY

It is an object to specify a method and a suitable structure for handling of an endless belt that makes the handling of an endless belt easier and prevents a damaging of the endless belt.

In a method and system for handling of an endless belt for an electro-photographic printer or copier, an endless belt is borne with aid of a first, a second, and a third cylindrical body. The first cylindrical body is inserted through a loop of the endless belt. The second cylindrical body is arranged outside of the loop of the endless belt and parallel to the first cylindrical body. The endless belt is wound around the first and the second cylindrical bodies. The third cylindrical body is provided through the loop at a free end of the endless belt. The cylindrical bodies with the wound endless belt are housed in a container.

DESCRIPTION OF THE PREFERRED EMBODIMENT

Figure 1:
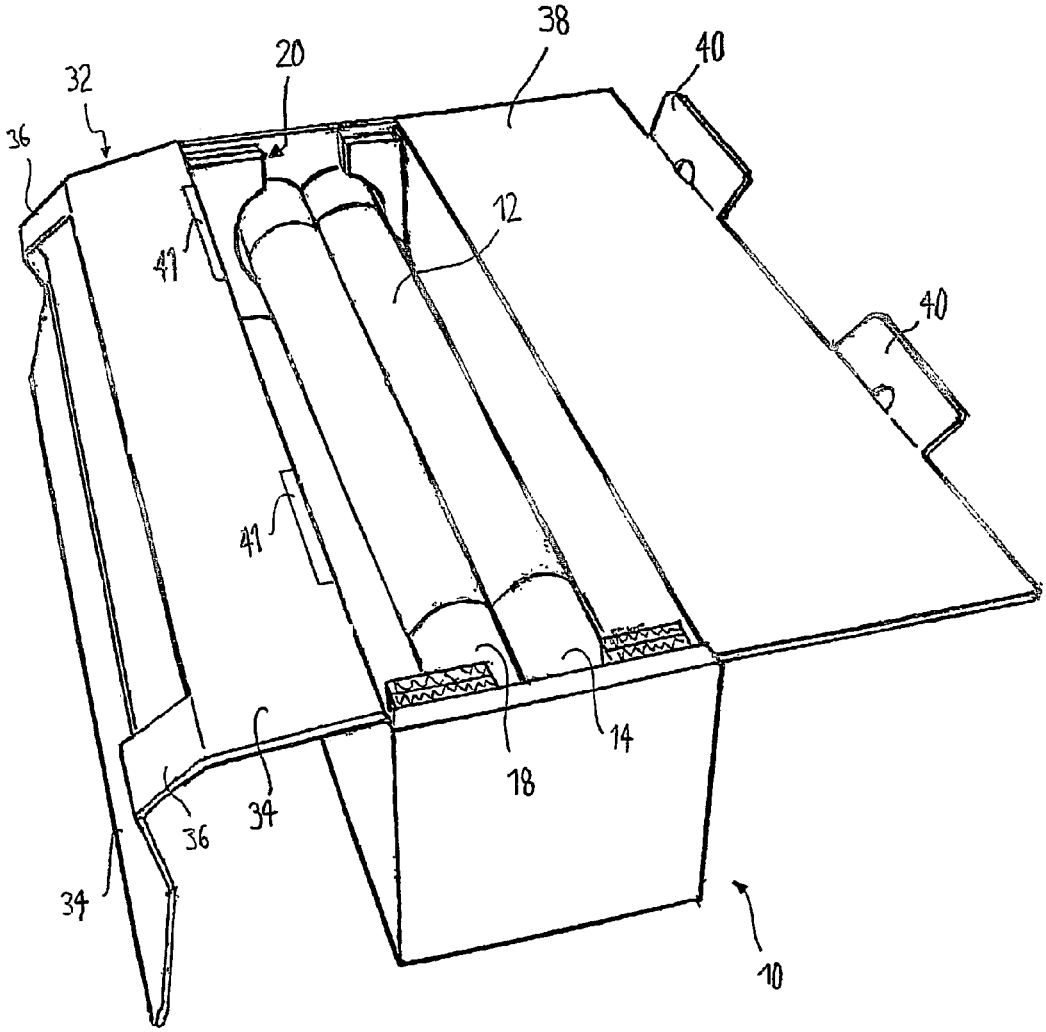
FIG. 1 is a perspective view of a unit that comprises an endless belt, a holder and a container.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

A unit with a holder that comprises three cylindrical bodies, of which a first is inserted through the loop of an endless belt and a second is arranged outside of the loop and parallel to the first cylindrical body, is known from DE 196 39 402 A1 and DE 28 35 167 A1. However, in these holders the endless belt is not wound around the first and the second cylindrical bodies. The known holders are thus not suited to a space-saving packaging or storage of endless belts.

The bearing of the endless belt of the preferred embodiment with the three cylindrical bodies is extremely compact, which is advantageous for the storage and the transport of the endless belt; it simultaneously prevents that the endless belt might buckle. When it is borne in the manner described above, the endless belt is actually at no point more significantly curved than the generated surface of the cylindrical bodies. Moreover, this bearing makes it easy for the user to unwind the endless belt, for example in order to insert it into a printer or copier. For this, the user must merely grasp the third cylindrical body at its ends and raise it into a horizontal position, whereby the endless belt is unwound from the first and the second cylindrical bodies without the user having to touch the belt and without the belt being buckled. This represents a large advantage relative to conventional methods for handling, in which the user often did not know how and at which point he should handle the endless belt for unwinding and the endless belt was often damaged via inappropriate handling.

The cylindrical bodies with the wound endless belt are preferably housed in a container for transport and/or for storage, whereby at least one of the cylindrical bodies protrudes at its ends over the width of the endless belt and the ends of this at least one cylindrical body that are uncovered by the endless belt are placed on supports provided in the container. A contact of the endless belt with the container can thus be prevented.

At least one of the supports preferably has a round support surface. The wound unit that is formed from the first cylindrical body, the second cylindrical body, and the endless belt wound around them can unroll on this round support surface when the third cylindrical body is raised from the container into a horizontal position. The endless belt can thus be unwound in the protection of the container, such that it can not be damaged.

At least one of the supports is preferably formed by a frame in which are arranged the ends of the cylindrical bodies that are uncovered by the endless belt. In an advantageous development, the frame is dimensioned so narrow that the wrapped unit and the third cylindrical body are kept together. It is thus prevented that the endless belt unwinds in the container and, for example, is damaged via contact with the container.

As already mentioned above, an important aspect of the handling of an endless belt for a printer or copier concerns the insertion of the same into the apparatus. A device for insertion of an endless belt into a printer or copier is disclosed from the German patent application 102 04 640 (not previously published) by the applicant, in which the endless belt is borne on at least two tubes and the printer or copier has mounts for the tubes that are arranged so that, upon mounting of the tubes on the mounts, the belt assumes the contour that the belt has in the printer or copier. To insert the belt, this must merely be slid over the tubes into the printer or copier.

In an advantageous development of the invention, the cylindrical bodies are formed as tubes. The tubes then serve not only for bearing of the endless belt, but rather also as guide aids for insertion of the endless belt in the printer or copier. Via the bearing (described above) of the endless belt on such tubes, the insertion of the endless belt in the printer or copier is further simplified because the first and the third tube are already located in the loop of the endless belt after the unwinding of the endless belt, meaning that the endless belt is already looped around two of the tubes. With the aid of the first and the third tube, the endless belt can then be carried in the unwound state to the printer or copier without it running the risk of being damaged.

For a better understanding of the present preferred embodiment, in the following reference is made to the preferred exemplary embodiment shown in the drawings, which is described using specific terminology. However, it is thereupon noted that the protective scope of the invention should not thereby be limited since such variations and further modifications to the shown method, the unit and the system as well as such further applications of the invention as they are shown therein are viewed as typical present or future expert knowledge of a competent average man skilled in the art.

In FIG. 1 a container 10 is shown in which a photoconductor belt 12 is accommodated that is borne with the aid of a first cardboard tube 14, a second cardboard tube 16 (occluded in FIG. 1) and a third cardboard tube 18. For this, the photoconductor belt 12 is wound in a manner described in detail below.

The ends of the cardboard tubes 14, 16 and 18 protrude over the width of the photoconductor belt 12. The ends of the tubes 14, 16 and 18 uncovered by the photoconductor belt are respectively arranged in a frame 20 that is particularly well-recognizable in FIG. 2.

Figure 2:
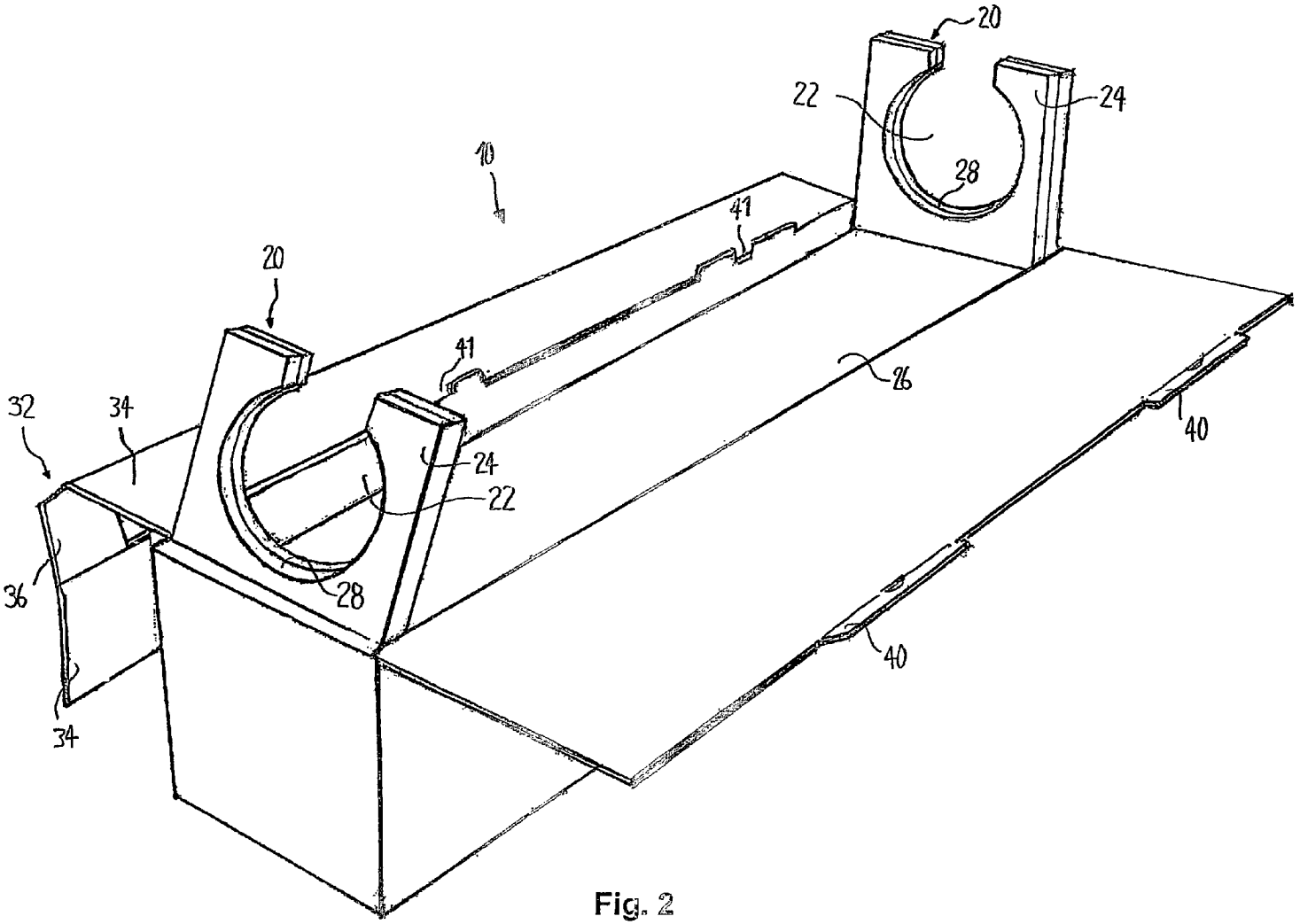
FIG. 2 is a perspective view of the container from FIG. 1, from which two frames have been extracted.

As is to be seen in FIG. 2, both frames 20 are respectively formed by a recess 22 in a carrier element 24. The carrier elements 24 are comprised of cardboard and are connected by a floor part 26. For better representation of the frames 20, in FIG. 2 the carrier elements 24 and the floor part 26 are extracted from the container 10.

The recess 22 in the carrier element 24 has a substantially circular segment through which a round support surface 28 is formed for the tubes 14, 16 and 18. As is to be seen in FIGS. 1 and 2, the recess 22 in the carrier element 24 extends upwards to the edge of the carrier element 24, whereby an opening 30 of the frame 20 is formed.

The container 10 has a lower cover 32 that is comprised of two oblong cover segments 34 that are respectively connected on the longitudinal ends by a crimped connection web 36 (FIG. 1). When the lower cover 32 is closed, the crimped web 36 folds together and extends from above into the opening 30 of the associated frame 20. The web 36 is so long that, given a closed cover 32, it protrudes between two of the tubes in the region of the ends uncovered by the photoconductor belt.

An upper cover 38 that has two tabs 40 is also arranged on the container 10. In order to seal the container 10, the lower cover 32 is first shut, then the upper cover 38 is turned over the lower cover 32, and finally the tabs 40 are inserted into associated recesses 41 (see FIG. 1).

Figure 3:
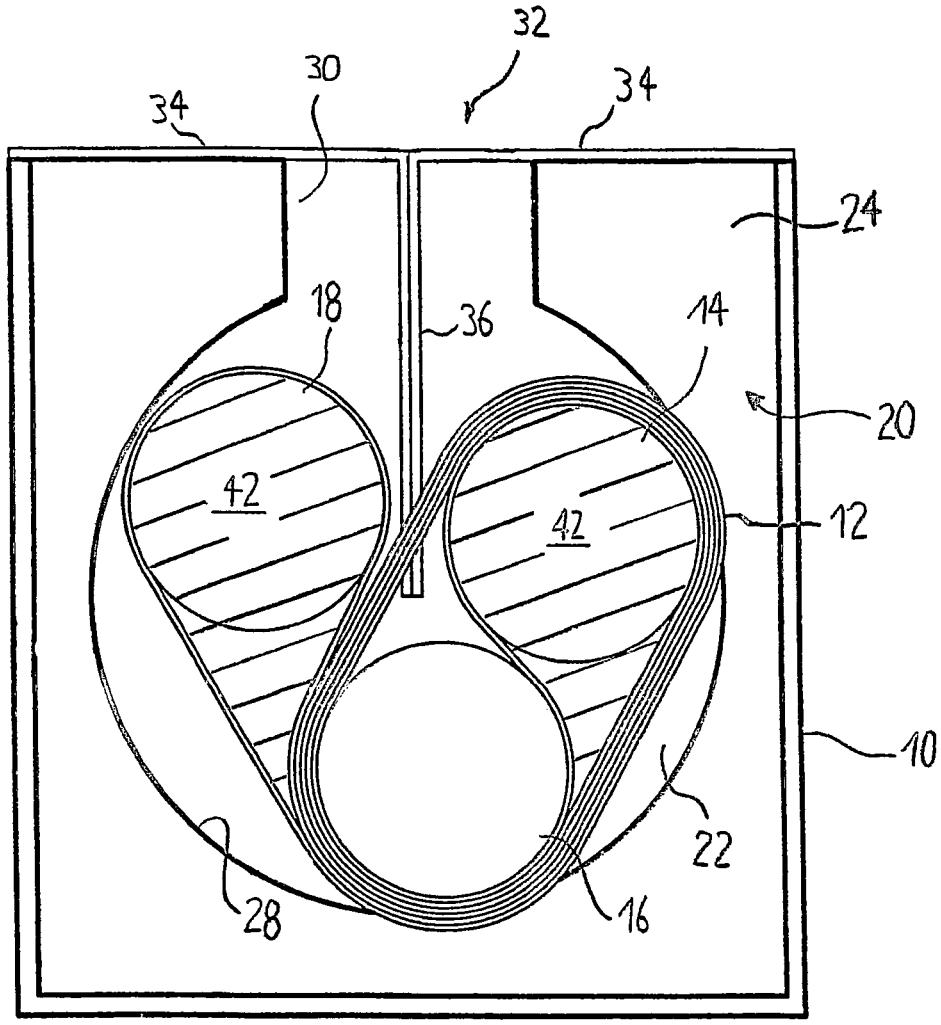
FIG. 3 is a schematically-shown cross-section view through the unit from FIG. 1 given a closed cover.

FIG. 3 shows a schematic cross-section view through the container 10 of FIG. 1. As is to be seen in FIG. 3, the ends of the first tube 14, the second tube 16 and the third tube 18 that are uncovered by the photoconductor belt 12 are resting on the round support surface 28 that is formed by the circular section of the recess 22 in the carrier element 24. In the representation of FIG. 3, the lower cover 32 is closed; and the upper cover 38 is not shown in FIG. 3. As is visible in FIG. 3, given a closed lower cover 32 the crimped web 36 folds together and protrudes from above into the opening 30 of the frame 20. The web 36 also projects between the first tube 14 and the third tube 18 at the ends not covered by the photoconductor belt 12.

The endless belt is held as follows with the aid of the three tubes 14, 16 and 18. The first tube 14 is placed through the loop of the photoconductor belt 12. In general, the space inscribed by the endless belt is by the loop of a photoconductor belt or of an endless belt. In FIGS. 3 through 7, the loop of the photoconductor belt 12 is designated with the reference character 42 and characterized by hatching. The second tube 16 is arranged parallel to the first tube 14 but outside of the loop 42 of the photoconductor belt 12. The photoconductor belt 12 is wound so often around the first tube 14 and the second tube 16 that the third tube 18 (which is inserted through the free end of the photoconductor 12) rests on the wound unit made from the first tube 14, the second tube 16, and the photoconductor belt 12 wound around them.

Figure 7:
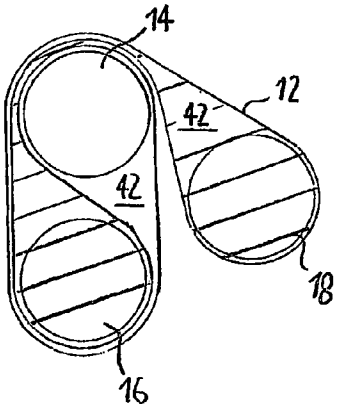
FIGS. 5 through 7 are schematic representations of three snapshots of the three cylindrical bodies and of the endless belt upon winding of the endless belt.
Figure 6:
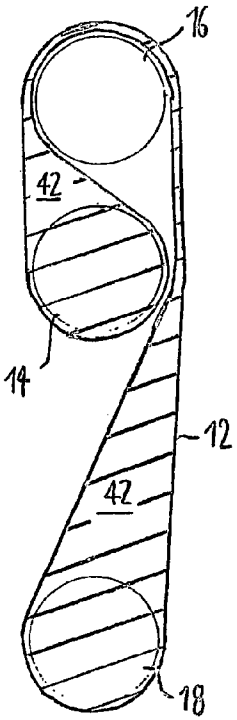
Figure 5:
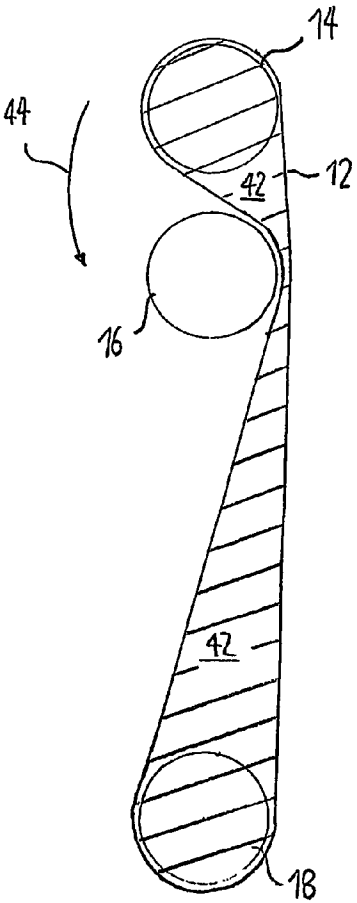

Under reference to FIGS. 5 through 7, using schematic drawings it is shown how such a winding can be achieved in a simple manner in the framework of a method for handling of the photoconductor belt 12. In FIG. 5, the photoconductor belt 12 is looped around the first tube 14 and is suspended therefrom. The third tube 18 lies in the loop 42 of the photoconductor belt and weighs down thereon. The second tube 16 is arranged next to the first tube 14 and parallel thereto, outside of the loop 42.

Via a common rotation of the first tube 14 and the second tube 16 in a direction characterized by the arrow 43, the photoconductor belt 12 is simultaneously wound around the first and the second tube 14, 16. FIG. 6 shows a snapshot of the arrangement of FIG. 5 after a common rotation of the first and the second tube by 180°, in which a half-winding of the photoconductor belt 12 is achieved.

In the following the photoconductor belt is wound around the first tube 14 and the second tube 16 until the third tube 18 rests on the wound unit that is formed from the first tube 14, the second tube 16 and the photoconductor belt 12 wound around these. This configuration is shown in FIG. 7.

In the schematic, purely illustrative representation of FIGS. 5 through 7, the photoconductor belt 12 is shown so short that, starting from the configuration from FIG. 5, it is already wound after one common rotation of the first tube 14 and of the second tube 16 by 360°. In contrast to this, given more realistic dimensions a plurality of windings would be required before the third tube 18 rests on the wound unit.

As is visible in FIG. 3, the frame 20 is dimensioned so narrow (meaning that the recess 22 in the carrier element 24 is designed so small) that the three tubes are held together by frame 20. It is thus prevented that the photoconductor belt 12 unwinds and thus could possibly come into contact with the container 10 and be damaged. On the one hand, the web 36 prevents that the common winding rotates in the recess 22; on the other hand, it prevents that the third roller 18 penetrates into the opening 30 of the frame 20, whereby the endless belt could likewise unwind.

The three tubes 14, 16 and 18, the frame 20 and the web 36 thus form a holder that, together with the photoconductor belt, form a unit that allows the photoconductor belt to be stored and transported safe from damage.

This unit moreover eases the handling of the photoconductor belt. As already shown in connection with FIGS. 5 through 7, the photoconductor belt 12 can easily be wound using the tubes 14, 16 and 18 without it having to be contacted (since the tubes can be gripped at the ends uncovered by the photoconductor belt), and without the photoconductor belt running the risk of being buckled.

Figure 4:
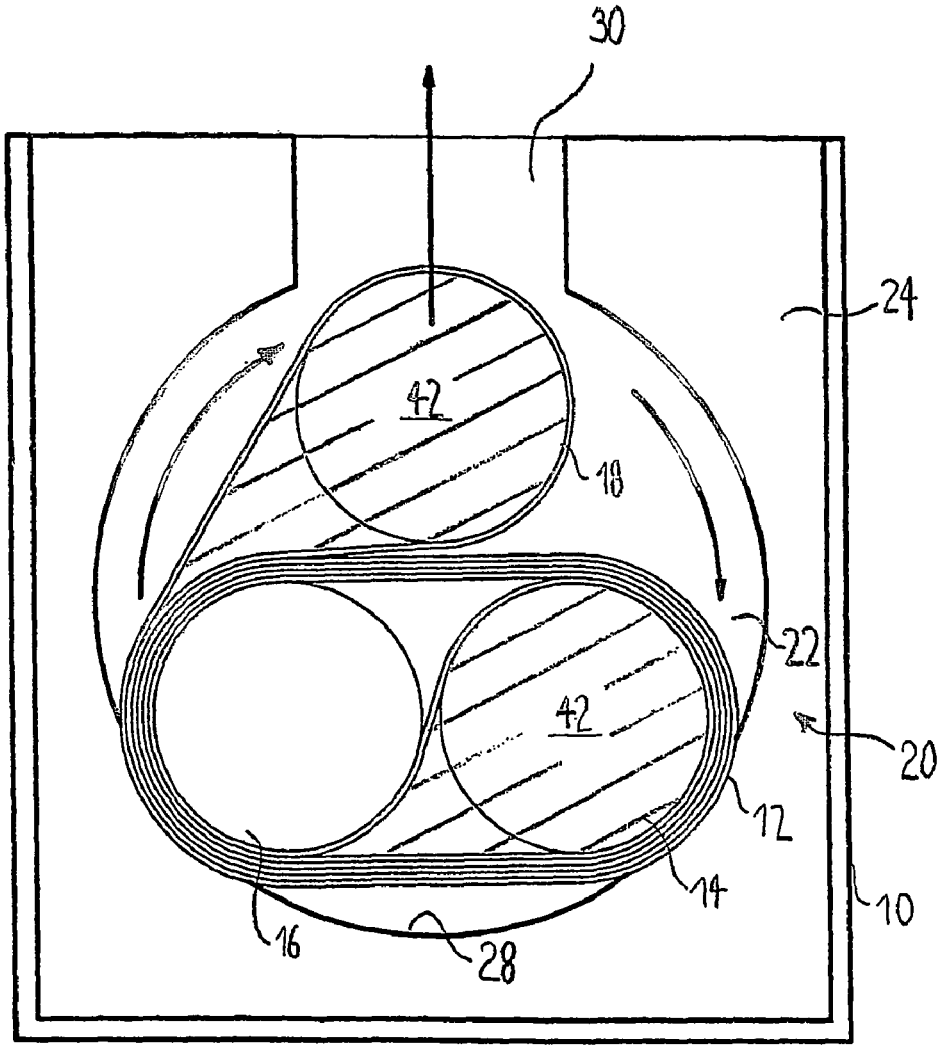
FIG. 4 shows a schematic section view from FIG. 3 without cover.

A further aspect of the handling of the photoconductor belt concerns the extraction from the container 10. For this, the upper cover 38 and the lower cover 32 are initially opened. After the opening of the lower cover, the web 36 no longer protrudes between the first and the third tube 18 (see FIG. 4), such that the three tubes 14, 16, 18 with the wound photoconductor belt 12 can be rotated in the frame 20 such that the third tube 18 rests above, as is shown in FIG. 4. The configuration of FIG. 4 results from the configuration of FIG. 3 via a rotation of the three tubes in the frame 20, which is indicated in FIG. 4 by the curved arrows. The user recognizes the third tube by an optical identifier, for example by its color.

The third tube 18 is subsequently gripped with both hands on its ends that are uncovered by the photoconductor belt 12 and is lifted from the frame 20 and the container 10 through the opening 30 in the frame 20 into a horizontal position, which is indicated in FIG. 4 by the vertical arrow. The photoconductor belt 12 thereby unwinds from the first tube 14 and the second tube, whereby the wound unit made up of the first tube 14, the second tube 16 and the photoconductor belt 12 wound around them unrolls on the round support surface 28 of the frame 20. This means that the photoconductor belt 12 unwinds in the protection of the container 10 and therefore is safe from damage during in the unwinding. When the entire photoconductor belt 20 is unwound, the first tube 14 lies below in the loop 42 of the photoconductor belt 12 suspended from the third tube 18 while the second tube 16, which was located outside of the loop 42, is free of the photoconductor belt 12 and rests loosely on the support surfaces 28 of both frames 20.

Figure 8:
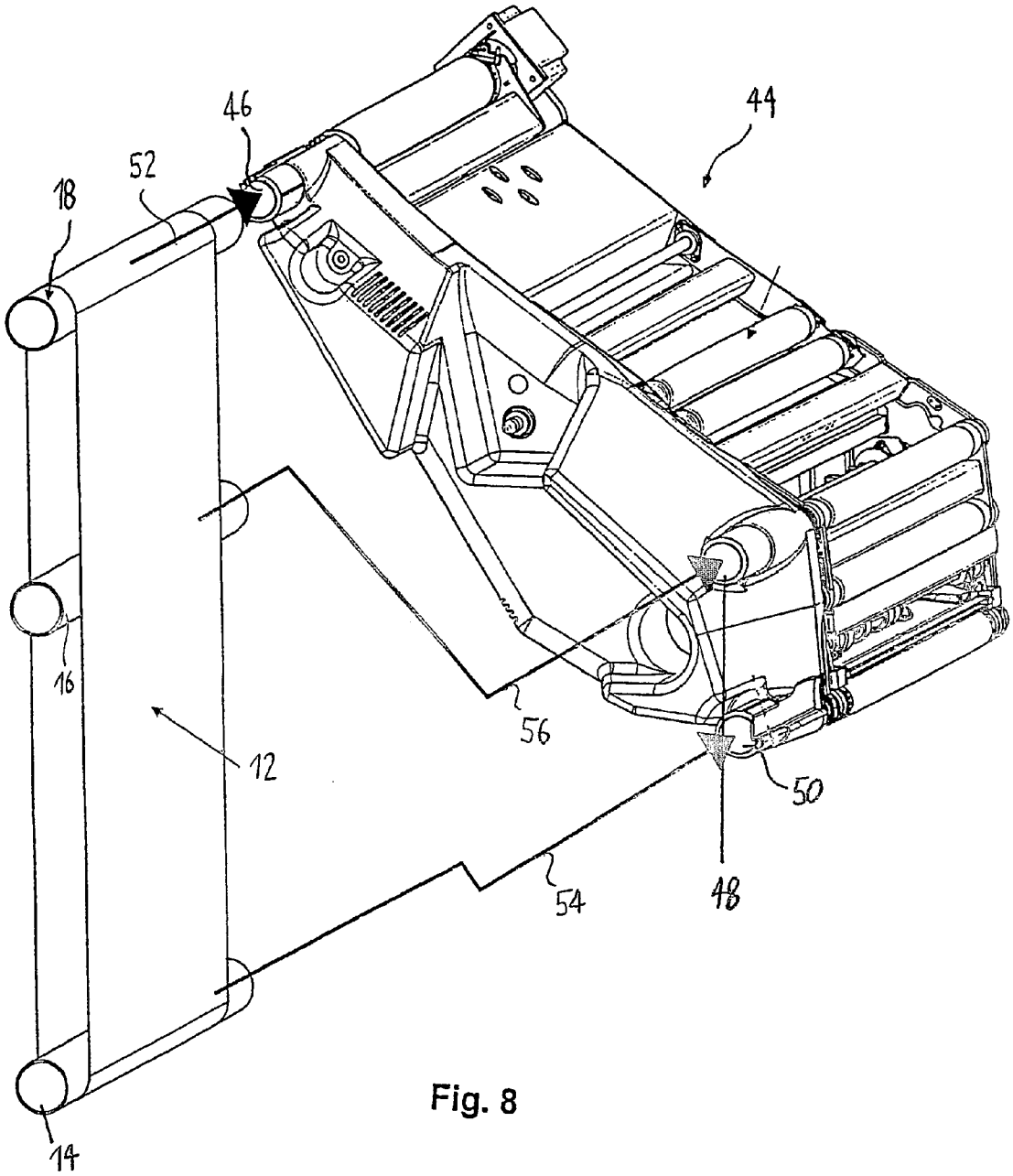
FIG. 8 is a perspective view of a belt transport device of an electrophotographic printer and of the endless belt that is looped around three tubes.

In FIG. 8 it is shown how the photoconductor 12 extracted from the container 10 in this manner is inserted into a printer or copier. Of the printer or copier, only the transport device 44 for the photoconductor belt 12 is shown in FIG. 8. The transport device 44 need not be described in detail here, since reference is made to WO 98/39691 for the details. An upper mount 46, a middle mount 48 and a lower mount 50 on which the tubes 14, 16 and 18 can be mounted are laterally arranged on the transport device 44. When, as described above, the photoconductor belt has been extracted from the container 10, it is suspended from the third tube 18 and is weighed down by the first tube 14 that lies in the loop 42 of the photoconductor belt 12. The third tube 18 is mounted on the upper mount 46, as is schematically shown by arrow 52. For easier orientation of the user, the affiliation of the upper mount 46 with the third tube 18 is optically identified, for example since they have the same color.

The first tube 14 is subsequently mounted on the lower mount 50, as indicated by arrow 54. Finally, the second tube 16 is taken from the container 10, guided by the loop 42 of the photoconductor belt 12 and mounted on the middle mount 48. The photoconductor belt looped around the three tubes 14, 16 and 18 then already has the shape that it has in the printer or copier when it is looped around the transport device 44. The photoconductor belt can then be slid across the three tubes 14, 16 and 18 onto the transport device 44.

The specified steps are executed in the reverse order to extract the photoconductor belt 12 from the printer or copier, whereby the photoconductor belt 12 is wound as described in connection with FIGS. 5 through 7.

As is clear from the preceding specification, the described unit made up of photoconductor belt and the described holder that, in the shown exemplary embodiment, is formed via a special packaging, make the handling of the photoconductor belt enormously easier. The danger of damage of the photoconductor belt upon handling is thereby distinctly reduced, and the handling is in fact simplified such that a trained technician is not necessarily required for exchange of the photoconductor belt; rather, this can also be effected by the user of the printer or copier.

The method described in the exemplary embodiment for handling of an endless belt for an electrophotographic printer or copier is not limited to a photoconductor belt, but rather is applicable for all types of endless belts, in particular for what are known as transfer belts with which a toner image is transferred from the photoconductor onto a recording medium. The described unit made from an endless belt and a holder is likewise not limited to the photoconductor belt of the exemplary embodiment, but rather can be used for every type of endless belt with the same advantages.

Although preferred exemplary embodiments are shown and described in detail in the drawings and in the preceding specification, they should be viewed as purely exemplary and not as limiting the invention. It is thereupon noted that only the preferred exemplary embodiments are shown and described, and all variations and modifications that presently and in the future lie within the protective scope of the invention should be protected.

We claim:

1. A method for handling of an endless belt for an electrophotographic printer or copier wherein the endless belt is to be borne with aid of a first, a second, and a third cylindrical body during mounting of the belt into said printer or copier comprising the steps of inserting the first cylindrical body through a loop of the endless belt; arranging the second cylindrical body outside of the loop of the endless belt and parallel to the first cylindrical body; winding the endless belt around the first and second cylindrical bodies to form a wound unit and inserting the third cylindrical body through the loop at a free end of the endless belt before or during the winding of the first and the second cylindrical bodies with the endless belt; placing the three cylindrical bodies with the wound unit in a container with said wound unit resting on a continuous, smooth, sliding support surface structure in the container; and extracting the endless belt from the container such that as the third cylindrical body is being raised upwardly from the container said wound unit unwinds while ends of said first and second cylindrical bodies are, being supported by, and slide along said support surface structure.

2. The method of claim 1 that support surface structure comprises first and second spaced apart support surfaces, said first and second cylindrical bodies have as said ends respective first and second opposite ends, and the first ends of the first and second cylindrical bodies resting on and sliding along the first support surface during said unwinding of the wound unit and the second ends of the first and second cylindrical bodies resting on and sliding along the second support surface during said unwinding of the wound unit.

3. The method of claim 2 wherein each of said first and second support surfaces are continuous without protrusions so that as said wound unit is unwinding, said wound unit slides along said support surfaces during said unwinding.

4. The method of claim 1 wherein said support surface structure comprises first and second support surfaces each of which are continuously curved, and opposite ends of said first, second and third cylindrical bodies extending beyond the endless belt respectively being in contact with said first and second curved surfaces when the wound unit and said third cylindrical body are positioned within said container.

5. The method according to claim 2 wherein the first and second support surfaces are round and have a removal opening above a rounded portion where said third cylindrical body is extracted upwardly as said wound unit begins to unwind.

6. The method according to claim 1 wherein the container has first and second flaps, and wherein the first flap has a web which, when the first flap is closed onto the container, is inserted between ends of said first and third bodies.

7. The method of claim 6 wherein the second flap folds over the first flap having the web when the first flap is closed.

8. The method of claim 1 wherein when placed in said container, said first and third bodies lie above said second body, and for removal, the first, second, and third bodies are rotated so that the third body is beneath an opening and then the third body is extracted upwardly while the wound unit formed of said first and second bodies unwinds on said support surface structure.

9. A container system for handling an endless belt, comprising: a container; in said container an endless belt with first and third cylindrical bodies inserted in the belt and a second cylindrical body outside of the belt, and said first and second bodies having the belt wound there-around to form a wound unit; and said container having a continuous, smooth, sliding support surface structure supporting said wound unit, said support surface structure being shaped such that when the third cylindrical body is pulled upwardly during removal from said container ends of said first and second cylindrical bodies of said wound unit rests on, is supported by, and slide along said support structure surface during unwinding of said wound unit.

* * * * *